US008220649B2

(12) United States Patent
Walsh

(10) Patent No.: US 8,220,649 B2
(45) Date of Patent: Jul. 17, 2012

(54) VENTING LINER AND METHOD

(75) Inventor: Edward D. Walsh, East Greenwich, RI (US)

(73) Assignee: Dewal Industries, Saunderstown, RI (US)

( * ) Notice: Subject to any disclaimer, the term of this patent is extended or adjusted under 35 U.S.C. 154(b) by 370 days.

(21) Appl. No.: 12/367,282

(22) Filed: Feb. 6, 2009

(65) Prior Publication Data

US 2009/0200308 A1 Aug. 13, 2009

Related U.S. Application Data

(60) Provisional application No. 61/027,253, filed on Feb. 8, 2008.

(51) Int. Cl.
*B65D 51/16* (2006.01)

(52) U.S. Cl. ..... 215/307; 215/261; 215/347; 215/902

(58) Field of Classification Search ..... 220/373, 220/367.1; 215/347, 363, 270, 307, 261, 215/902

See application file for complete search history.

(56) References Cited

U.S. PATENT DOCUMENTS

| | | | |
|---|---|---|---|
| 2,602,559 | A | 7/1952 | Dryer |
| 3,071,276 | A | 1/1963 | Pellett et al. |
| 3,263,850 | A | 8/1966 | Scott |
| 3,315,831 | A | 4/1967 | Scott |
| 3,318,836 | A | 5/1967 | Cubitt |
| 3,326,401 | A | 6/1967 | De Long |
| 3,448,882 | A | 6/1969 | Roy |
| 3,466,444 | A | 9/1969 | Lusk |

(Continued)

FOREIGN PATENT DOCUMENTS

| | | | |
|---|---|---|---|
| EP | 1095764 | A2 | 5/2001 |

(Continued)

OTHER PUBLICATIONS

International Search Report and Written Opinion of Apr. 20, 2009 for PCT US 09/003452.

(Continued)

*Primary Examiner* — Mickey Yu
*Assistant Examiner* — Chun Cheung
(74) *Attorney, Agent, or Firm* — McCarter & English, LLP

(57) ABSTRACT

A venting liner is connectable in fluid communication between a closure and an interior of a device for venting gas from the interior into the ambient atmosphere. The venting liner has an outer foam layer defining an inner surface and an outer surface, a plurality of fluid-flow apertures spaced relative to each other, extending between the inner and outer surfaces, and forming substantially vertical fluid-flow paths through the outer layer, and a plurality of relatively raised portions extending outwardly relative to the outer surface adjacent to respective fluid-flow apertures. A plurality of the relatively raised portions are engageable with the closure, define a substantially horizontal, tortuous fluid-flow path between the outer surface and the closure, and are in fluid communication with a plurality of fluid-flow apertures for venting gas flowing substantially vertically through the fluid-flow aperture(s) and, in turn, substantially horizontally between the outer surface and the closure. An inner layer defines a plurality of pores in fluid communication with a plurality of the fluid-flow apertures of the outer layer that substantially prevent the flow of liquid through the inner layer and allow the flow of gas from the interior of the device through the pores, into a plurality of the fluid-flow apertures and, in turn, through the substantially horizontal fluid-flow path and into the ambient atmosphere.

20 Claims, 4 Drawing Sheets

U.S. PATENT DOCUMENTS

| | | | | | |
|---|---|---|---|---|---|
| 3,471,051 | A | | 10/1969 | Cistone | |
| 3,521,784 | A | | 7/1970 | Gaines et al. | |
| 3,557,989 | A | | 1/1971 | Balda | |
| 3,866,845 | A | | 2/1975 | Keeler et al. | |
| 3,951,293 | A | | 4/1976 | Schultz | |
| 3,971,489 | A | | 7/1976 | Welch et al. | |
| 4,044,994 | A | | 8/1977 | Priese | |
| 4,121,728 | A | * | 10/1978 | Tagalakis et al. | 215/260 |
| 4,175,671 | A | | 11/1979 | Holl et al. | |
| 4,457,440 | A | | 7/1984 | Dukess | |
| 4,596,338 | A | | 6/1986 | Yousif | |
| 4,765,499 | A | | 8/1988 | Von Reis et al. | |
| 4,789,074 | A | | 12/1988 | Ham | |
| 4,884,716 | A | | 12/1989 | Steiner | |
| 5,289,932 | A | | 3/1994 | Dimeo et al. | |
| 5,579,936 | A | | 12/1996 | Costa et al. | |
| 5,598,940 | A | | 2/1997 | Finkelstein et al. | |
| 5,692,634 | A | | 12/1997 | Jenkins et al. | |
| 5,730,306 | A | * | 3/1998 | Costa et al. | 215/261 |
| 5,853,096 | A | | 12/1998 | Bartur et al. | |
| 5,964,465 | A | | 10/1999 | Mills et al. | |
| 6,196,409 | B1 | | 3/2001 | Lake et al. | |
| 6,202,870 | B1 | * | 3/2001 | Pearce | 215/307 |
| 6,257,455 | B1 | | 7/2001 | Trepina et al. | |
| 6,399,696 | B1 | | 6/2002 | Toyosawa et al. | |
| 6,715,772 | B1 | | 4/2004 | Micciche et al. | |
| 6,983,857 | B2 | * | 1/2006 | Miller et al. | 215/270 |
| 7,461,754 | B2 | | 12/2008 | Walsh | |
| 2001/0047977 | A1 | | 12/2001 | Forman | |
| 2005/0248097 | A1 | | 11/2005 | Walsh | |

FOREIGN PATENT DOCUMENTS

| | | | |
|---|---|---|---|
| EP | 1095764 | A3 | 9/2002 |

OTHER PUBLICATIONS

Tri-Seal Technical Data Sheet F- 217-3, Available at www.tri-seal.com.

International Search Report and Written Opinion of Nov. 10, 2009, for PCT/US2009/036893.

International Preliminary Report on Patentability for International Application No. PCT/US2009/035927.

* cited by examiner

VENTING LINER AND METHOD

CROSS-REFERENCE TO PRIORITY APPLICATION

This patent application claims priority to U.S. provisional patent application Ser. No. 61/027,253, filed Feb. 8, 2008, entitled "Venting Liner And Method", which is hereby expressly incorporated by reference in its entirety as part of the present disclosure.

FIELD OF THE INVENTION

The present invention relates to venting liners and methods of making venting liners, and more particularly, to venting liners that are connectable in fluid communication between a closure and an interior of a device for venting gases therethrough and to methods of making and using venting liners.

BACKGROUND OF THE INVENTION

Containers are often used to retain or store various temperature and/or pressure sensitive substances, such as aqueous solutions, peroxides, chlorines, alcohols, aromatics, ketones, and other chemically active substances. Containers storing substances that are subject to changes in pressure, temperature, altitude and other factors affecting packaging conditions require venting to avoid the negative effects that can result from retaining such sensitive substances in a container. Failure to adequately seal the liquids within the container could result in leakage. Failure to adequately vent the container may result in a pressure differential between the inside of the container and the outside of the container, which in turn may cause the container to collapse, swell or explode.

Various venting arrangements have been developed in an effort to reduce or eliminate the negative effects associated with poorly vented containers. For example, it is known to utilize a polytetrafluoroethylene (PTFE) liner or an expanded polytetrafluoroethylene (ePTFE) liner to vent a container. PTFE and ePTFE liners have a microporous structure that repels liquids while safely allowing for the free passage of gas, thus enabling their use in venting liners. These liners typically cooperate with a venting aperture located in a cap above the liner or have a number of grooves in the upper surface of the liner that cooperate with the threads of a cap to vent the container.

It is also known to combine a bottom layer of liquid-impermeable and gas-porous material with a top layer of elastomeric material, wherein the top layer defines a plurality of apertures extending through it in fluid communication with grooves furrowed into the upper surface of the top layer. When in cooperation with a container closure, the gas is vented through the apertures and then out through the grooves. An exemplary such liner is shown in U.S. Pat. No. 5,730,306.

One drawback associated with such prior art venting liners is that they can exhibit limited venting capacity due to constraints in the sizes of the venting apertures and grooves. Yet another drawback is that such venting liners can be more expensive than desired.

Accordingly, it is an object of the present invention to overcome one or more of the above-described drawbacks and/or disadvantages of the prior art.

SUMMARY OF THE INVENTION

In accordance with a first aspect, the present invention is directed to a venting liner connectable in fluid communication between a closure and an interior of a device for venting gas from the interior into the ambient atmosphere. The venting liner comprises an outer layer, such as a foam layer, defining an inner surface and an outer surface, a plurality of fluid-flow apertures spaced relative to each other, extending between the inner and outer surfaces, and forming substantially vertical fluid-flow paths through the outer layer. An inner layer of the venting liner defines a plurality of pores in fluid communication with at least a plurality of the fluid-flow apertures of the outer layer that substantially prevent the flow of liquid through the inner layer and allow the flow of gas from the interior of the device through the pores, into at least a plurality of the fluid-flow apertures and, in turn, through at least one substantially horizontal fluid-flow path formed between the outer layer and closure, and/or through at least one substantially vertical fluid-flow path through the closure, and into the ambient atmosphere.

In some embodiments of the present invention, the outer layer further defines and a plurality of relatively raised portions extending outwardly relative to the outer surface adjacent to respective fluid-flow apertures. At least a plurality of the relatively raised portions are engageable with the closure, define at least one substantially horizontal fluid-flow path between the outer surface and the closure, and are in fluid communication with at least one fluid-flow aperture for venting gas flowing substantially vertically through the fluid-flow aperture(s) and, in turn, substantially horizontally between the outer surface and the closure.

In some embodiments of the present invention, the outer surface of the outer layer is substantially planar. In some embodiments, the plurality of relatively raised portions are formed by outer layer material extruded out of at least one respective aperture when forming the aperture. In some embodiments, the inner layer is laminated directly to the outer layer without any intervening layers. In some embodiments, the at least one substantially horizontal fluid-flow path between the outer surface and the closure is tortuous.

In accordance with another aspect, the venting liner is made in accordance with a method comprising the steps of extruding the outer layer material in the direction from the inner surface toward the outer surface at a plurality of locations spaced relative to each other and, in turn, forming the relatively raised portions with the extruded material, and the fluid-flow apertures with voids in the outer layer resulting from the extruding and/or stretching.

In some embodiments of the present invention, the extruding step comprises:

(i) piercing the outer layer with at least one extrusion member, such as a pin or needle;

(ii) extruding outer layer material with the at least one extrusion member in the direction from the inner surface toward the outer surface of the outer layer;

(iii) depositing extruded outer layer material in relatively raised portions extending outwardly relative to the outer surface of the outer layer; and (iv) removing the at least one extrusion member from the outer layer and, in turn, forming the fluid-flow paths at the penetration locations of the at least one extrusion member.

In some such embodiments, the extruding step further comprises extruding the outer layer material with a plurality of extrusion members laterally spaced relative to each other.

In accordance with another aspect, the present invention is directed to a venting liner connectable in fluid communication between a closure and an interior of a device for venting gas from the interior into the ambient atmosphere. The venting liner comprises first means for forming an outer surface of the venting liner. The first means includes a plurality of second means spaced relative to each other for forming a plurality of substantially vertical fluid-flow paths through the first means. Third means are provided for forming an inner surface of the venting liner. The third means includes a plurality of fourth means in fluid communication with at least a plurality of the second means for substantially preventing the flow of liquid through the fourth means and allowing the flow of gas from the interior of the device through the fourth means, into at least a plurality of the second means and, in turn, through at least one substantially horizontal fluid-flow path formed between the first means and closure, and/or through at least one substantially vertical fluid-flow path through the closure, and into the ambient atmosphere.

In some embodiments of the present invention, the venting liner further comprises a plurality of fifth means extending outwardly relative to the outer surface adjacent to respective second means for engaging the closure, defining at least one substantially horizontal fluid-flow path between the outer surface and the closure, and in fluid communication with at least one second means for venting gas flowing substantially vertically through the second means and, in turn, substantially horizontally between the outer surface and the closure.

In some embodiments of the present invention, the first means is a foam layer, the second means is a plurality of fluid-flow apertures, the third means is an inner layer of the venting liner, the fourth means is a plurality of pores formed in the inner layer, and the fifth means is a plurality of relatively raised portions.

In accordance with another aspect, the present invention is directed to a method comprising the following steps:

(i) providing an outer layer of a venting liner defining an inner surface and an outer surface;

(ii) extruding the outer layer in the direction from the inner surface toward the outer surface at a plurality of locations spaced relative to each other on the outer layer and, in turn, forming at each extrusion location a relatively raised portion extending outwardly relative to the outer surface and a fluid-flow aperture extending between the inner and outer surfaces and forming a substantially vertical fluid-flow path through the outer layer; and (iii) laminating an inner layer defining a plurality of pores to the outer layer with the pores in fluid communication with at least a plurality of the fluid-flow apertures of the outer layer and, in turn, forming a venting liner that vents gas substantially vertically through the pores of the inner layer and the fluid-flow apertures of the outer layer, and substantially horizontally between the relatively raised portions formed on the outer surface of the outer layer.

In some embodiments of the present invention, the method further comprises connecting the venting liner in fluid communication between a device and a closure; substantially preventing the flow of liquid through the inner layer and allowing the flow of gas from the interior of the device through the pores, into at least a plurality of the fluid-flow apertures and, in turn, through the at least one substantially horizontal fluid-flow path and into the ambient atmosphere.

In some embodiments of the present invention, the extruding step comprises:

(i) piercing the outer layer with at least one extrusion member, such as a pin or needle;

(ii) extruding outer layer material with the at least one extrusion member in the direction from the inner surface toward the outer surface of the outer layer;

(iii) depositing extruded outer layer material in relatively raised portions extending outwardly relative to the outer surface of the outer layer; and (iv) removing the at least one extrusion member from the outer layer and, in turn, forming the fluid-flow paths at the penetration locations of the at least one extrusion member.

In some such embodiments, the extruding step further comprises piercing the outer layer with a plurality of extrusion members laterally spaced relative to each other. In some such embodiments, the extruding step further comprises supporting the outer layer on a support surface defining a plurality of die apertures spaced relatively to each other; and driving a plurality of extrusion members aligned with respective die apertures through the outer layer to extrude the outer layer material and, in turn, form the relatively raised portions and fluid-flow apertures. In some such embodiments, the extruding step further includes driving extrusion members in the form of pins defining pointed tips, and receiving the pointed tips within the corresponding die apertures when piercing the outer layer with the pins. In some such embodiments, the extruding step further includes extruding the outer layer material into approximately annular spaces formed between the pins and the portions of the support surfaces forming the respective die apertures. In some such embodiments, the extruding step includes moving the outer layer between a rotatably mounted roller including the plurality of pins mounted thereon and a support surface spaced therefrom.

One advantage of the present invention is that the substantially vertical fluid-flow apertures cooperate with the porous inner layer to allow substantial venting capacity. Another advantage is that the venting capacity can be adjusted by adjusting the size and/or number of the substantially vertical fluid-flow apertures in the outer layer. Another advantage is that the liner can be manufactured relatively cost effectively.

Other objects and advantages of the present invention and/or of the currently preferred embodiments thereof will become more readily apparent in view of the following detailed description of the currently preferred embodiments and accompanying drawings.

DETAILED DESCRIPTION OF THE CURRENTLY PREFERRED EMBODIMENTS

Figure 1:
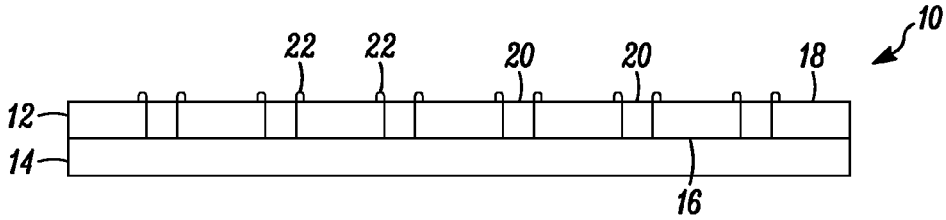
FIG. 1 is a cross-sectional view of a venting liner embodying the present invention.

Referring to the drawings and, in particular, to FIG. 1, a venting liner in accordance with an illustrative embodiment of the present invention is indicated generally by the reference numeral 10. The venting liner 10 comprises a first or outer layer 12 and a second or inner layer 14 laminated to the outer layer 12. The term "venting liner" is used herein to mean a liner or other device for venting a container or any other device that may require venting, wherein the liner may, if desired, provide a seal for sealing, for example, a closure to the container or other device.

Figure 2:
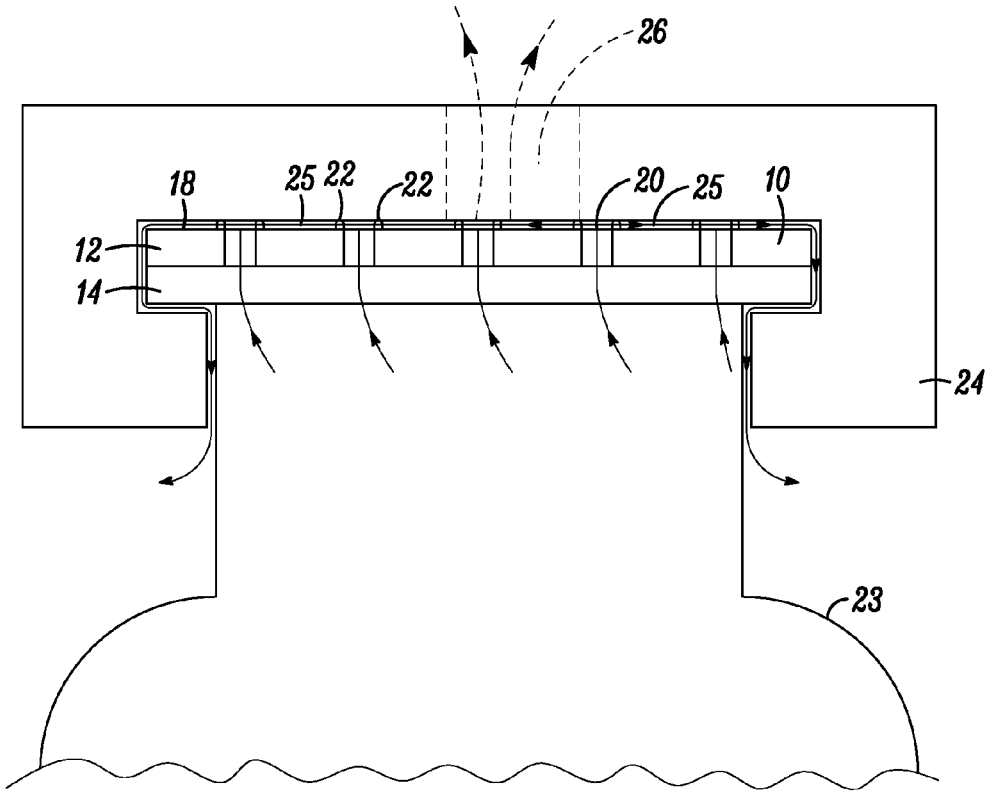
FIG. 2 is a somewhat schematic, cross-sectional view of the venting liner of FIG. 1 seated between a container neck and closure for venting gases from the interior of the container into the ambient atmosphere.

The outer layer 12 defines an inner surface 16, an outer surface 18, and a plurality of fluid-flow apertures 20 extending between the inner surface and the outer surfaces and forming a plurality of substantially vertical fluid-flow paths extending through the layer. The terms "substantially vertical" or "substantially vertical fluid flow" are used herein to mean fluid flow that is vertical, almost vertical or generally upwardly directed. The venting liner 10 includes a plurality of nubs, protuberances or other relatively raised portions 22 formed on the outer surface 18 of the outer layer 12 adjacent to the outlet end of each fluid-flow aperture 20. As described further below, the fluid-flow apertures 20 define substantially vertical fluid-flow paths for venting gas therethrough. In the illustrated embodiment, the nubs 22 cooperate with an overlying closure to define a plurality of substantially horizontal fluid-flow paths to, in turn, vent gas substantially horizontally between the outer layer of the liner and the closure and, in turn, into the ambient atmosphere. As indicated in FIG. 2, the gas may vent horizontally and then downwardly between the closure and bottle neck and into the ambient atmosphere (e.g., through the threads of the closure), and/or may vent substantially vertically through the closure and into the ambient atmosphere (e.g., through one or more substantially vertical apertures 26 formed through the closure). The terms "substantially horizontal" or "substantially horizontal fluid flow" are used herein to mean fluid flow that is horizontal, almost horizontal, or generally laterally directed. The inner layer 14 is a porous layer that is substantially liquid impervious and gas permeable. Accordingly, the inner layer 14 does not permit the passage of liquid, but does permit the passage of gas substantially vertically through the inner layer 14 and into the apertures 20 of the outer layer 12.

Turning to FIG. 2, the venting liner 10 is engageable with an exemplary closure 24 such that the inner layer 14 forms liquid-tight seal between the neck of an exemplary container body 23 and the closure. When the closure 24 is secured to the container body 23, the venting liner 10 is compressed between the land on the neck of the container body 23 and the closure 24, and at least a plurality of the nubs 22 of the liner engage an opposing inner surface of the closure 24 to thereby define a horizontally extending space 25 between the outer surface 18 of the liner and closure. Accordingly, as indicated by the exemplary arrows in FIG. 2, gas from the interior of the container body 23 is permitted to vent substantially vertically through the inner layer 14 and fluid-flow apertures 20 of the outer layer 12, and in turn substantially horizontally through the fluid-flow path 25 between the laterally spaced nubs 22 and out into the ambient atmosphere. In the illustrated embodiment, the gas flows from the substantially horizontal fluid-flow path 25 downwardly into a fluid-flow path defined by the threaded connection between the closure 24 and the neck of the container body 23. However, as may be recognized by those of ordinary skill in the pertinent art based on the teachings herein, the closure and container or other device may take any of numerous different configurations that are currently known, or that later become known, and the venting arrangement of the closure and/or device may take any of numerous different configurations that are currently known, or that later become known. For example, as illustrated in broken lines in FIG. 2, the closure 24 may include one or more venting apertures 26 formed in an upper wall thereof to allow the venting of gas from the substantially horizontal extending fluid-flow path 25 substantially vertically therethrough. The venting liner 10 can be designed and/or adjusted to accommodate any of a variety of different application requirements, including without limitation cap liners, closures (e.g., wherein the liner is used to seal a closure to a container or other device, and may be a separate element or may be formed integral with the closure, container and/or other device), and battery applications, and can be used to seal within a container or other device any of a variety of liquids and to vent any of a variety of gases.

As may be recognized by those of ordinary skill in the pertinent art based on the teachings herein, the outer layer 12 may be formed from any of a variety of materials that are currently known, or that later become known for performing the function of the outer layer, including any of a variety of chemically resilient and/or temperature resistant materials. The outer layer 12 can be woven, non-woven or otherwise formed from various types of fibrous or non-fibrous materials. The outer layer 12 is preferably easily handled during manufacture, may be cut or shaped to fit any of a variety of geometries, and may be formed into films as thin as about 0.002 inch. The outer layer 12 preferably may be converted from hydrophobic to hydrophilic and vice versa. The outer layer 12 also may be either oleophilic or oleophobic. The outer layer 12 preferably may be bonded to nearly any material, including, for example, polypropylene materials, polyethylene materials, polyester materials, Kevlar®, glass fabrics, and a variety of other materials. The outer layer 12 preferably defines a thickness within the range of about 10 mils to about 125 mils. In one embodiment of the present invention, the outer layer 12 is a porolated, multiple layer or ply material including an inner foam layer and opposing outer substantially solid layers. In some such embodiments, the inner foam layer is a low density polyethylene foam, and the opposing outer layers are substantially solid low density polyethylene layers, wherein the three layers are co-extruded or otherwise laminated to each other. In some such embodiments, the foam is a closed cell foam such that the gas does not vent horizontally therethrough, but rather vents substantially vertically through the fluid-flow apertures 20. Some such materials are sold under the designations F-217-3 and F-217 by Tri-Seal Company, having an address at 900 Bradley Hill Road, Blauvelt, N.Y. 10913, U.S.A. As may be recognized by those of ordinary skill in the pertinent art based on the teachings herein, these materials are only exemplary, and numerous other materials that are currently known, or that later become known, equally may be employed to form the outer layer 12. For example, in other embodiments of the present invention, the outer layer 12 is not a foam layer, but rather is made of another plastic material, such as a solid or substantially solid polyethylene or polypropylene, a silicon material, such as a silicone rubber, a resilient thermoplastic material, such as a thermoplastic elastomer, or another elastomeric material. In other embodiments of the present invention, the foam layer includes more or less layers than the three-layer material described herein.

As may be recognized by those of ordinary skill in the pertinent art based on the teachings herein, the second or inner layer 14 may be formed from any of a variety of materials that are currently known, or that later become known for performing the function of the inner layer, including any of a variety of chemically resilient and/or temperature resistant materials. The inner layer 14 may be woven, non-woven or otherwise formed from various types of fibrous or non-fibrous materials. In some embodiments of the present invention, the inner layer 14 is formed from a low density extruded, unsintered and highly porous material, such as a polytetrafluoroethylene (PTFE), an expanded PTFE (ePTFE), or variations or modifications of either of the foregoing materials. In some such embodiments, the PTFE or ePTFE inner layer 14 defines a thickness within the range of about 0.001 inch to about 0.01 inch, preferably within the range of about 0.002 inch to about 0.006 inch, and most preferably within the range of about 0.003 inch to about 0.005 inch, and in one such embodiment, a thickness of about 0.004 inch. The inner layer 14 is preferably hydrophobic or liquid impermeable, easily handled during manufacture, and preferably may be cut or shaped to fit any of a variety of geometries. The inner layer 14 is preferably usable over a broad temperature range, from as high as about 260° C. to as low as about −268° C. In some embodiments of the present invention, the pore size distribution of the inner layer 14 is within the range of about 0.05 microns to about 5 microns. In one such embodiment, an inner PTFE or ePTFE layer defines a porosity within the range of about 10% to about 90% open area (by volume), and preferably within the range of about 30% to about 50% open area (by volume). If desired, the inner layer 14 may be converted from the preferred hydrophobic form to a hydrophilic form. The inner layer 14 also may be either oleophilic or oleophobic.

The inner PTFE or ePTFE layer(s) 14 are compressible, and therefore form fluid-tight seals against the surfaces with which they are compressed, such as the closure and container opening surfaces. The outer foam layer 12, on the other hand, is more resilient than the inner PTFE or ePTFE layers 14 to facilitate forming a fluid-tight seal. The outer foam layer 12 will tend to return to its original shape after being compressed, whereas the inner PTFE or ePTFE layers 14 will typically take on a set or will tend not to go back to their original shape after being compressed. Thus, the inner PTFE or ePTFE layer 14 facilitates in forming a fluid-tight seal between the liner 10 and the closure, and the outer foam layer 12 facilitates in maintaining that seal during storage and/or shelf life, and/or after a closure is removed and resealed to the container or other device.

As may be recognized by those of ordinary skill in the pertinent art based on the teachings herein, the venting liner 10 may include one or more additional layers to address the requirements or performance objectives of any of a variety of applications that are currently known, or that later become known. For example, the venting liner may include plural inner layers, plural outer layers, and/or intervening layers between the inner and outer layers. In some such examples the liner may include plural layers as disclosed in co-pending U.S. Pat. No. 7,461,754, entitled "Gasket For Horizontal Venting And Related Method", which is assigned to the Assignee of the present invention and is hereby expressly incorporated by reference in its entirety as part of the present disclosure. In addition, the layers may be laminated or otherwise fixedly secured to one another in any of numerous different ways that are currently known or that later become known to those of ordinary skill in the pertinent art, including without limitation laminating processes that apply heat and pressure, such as by calendaring the layers or by autoclaving the layers, and/or any of such processes that apply adhesives, bonding agents, and/or surface treatments to facilitate fixedly securing contiguous layers to each other.

Figure 3A:
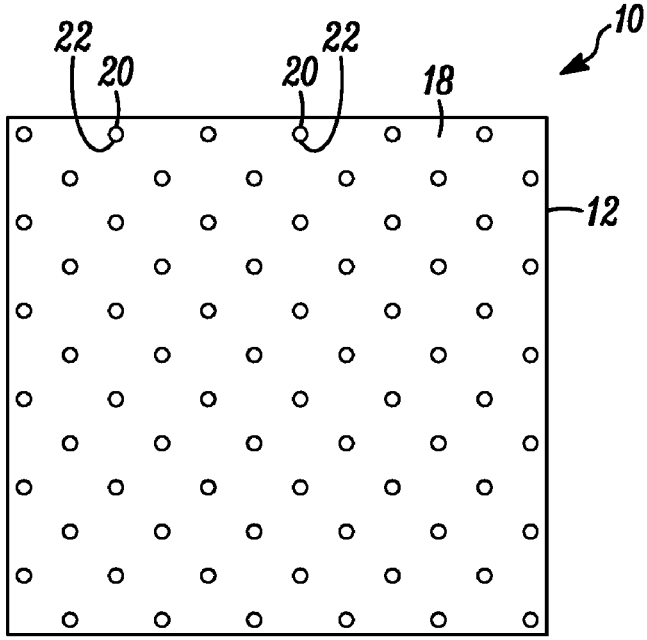
FIG. 3A is a somewhat schematic, top plan view of a portion of a venting liner of the present invention illustrating an exemplary fluid-flow aperture pattern formed in the outer layer of the liner.
Figure 3B:
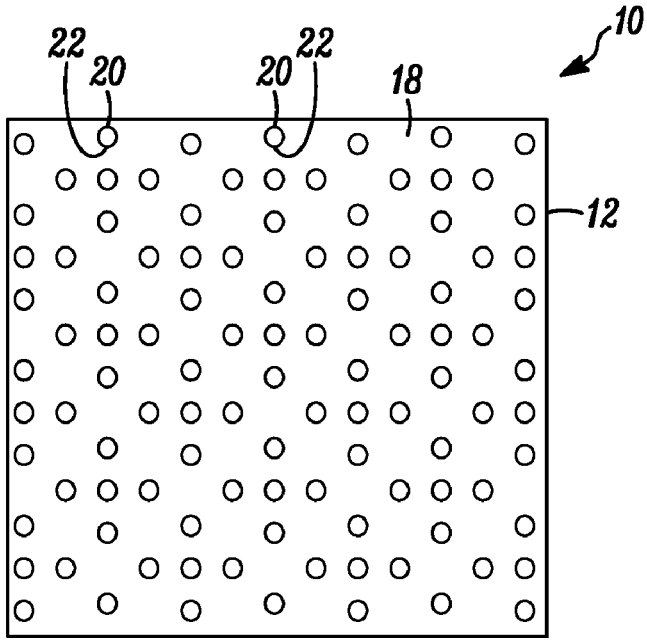
FIG. 3B is another somewhat schematic, top plan view of a portion of another venting liner of the present invention illustrating another exemplary fluid-flow aperture pattern formed in the outer layer of the liner.

Referring to FIGS. 3A and 3B, the fluid-flow apertures 20 of the outer layer 12 may be formed in any of a variety of patterns that are currently known or that later become known. As shown in FIG. 3A, the fluid-flow apertures 20 may be formed in rows wherein the apertures are substantially equally spaced relative to each other. As shown in FIG. 3B, the fluid-flow apertures 20 alternatively may be formed in a more random pattern as compared to the pattern of FIG. 3A. In other embodiments of the present invention, the fluid-flow aperture pattern may be more heavily distributed in one portion of the outer layer 12 as opposed to other portions of the outer layer to direct the gas flow in a particular manner. Likewise, the size(s) of the fluid-flow apertures 20 may be varied or otherwise adjusted to direct gas flow in a particular manner and/or to otherwise control the characteristics of the gas flow through the liner.

Figure 4:
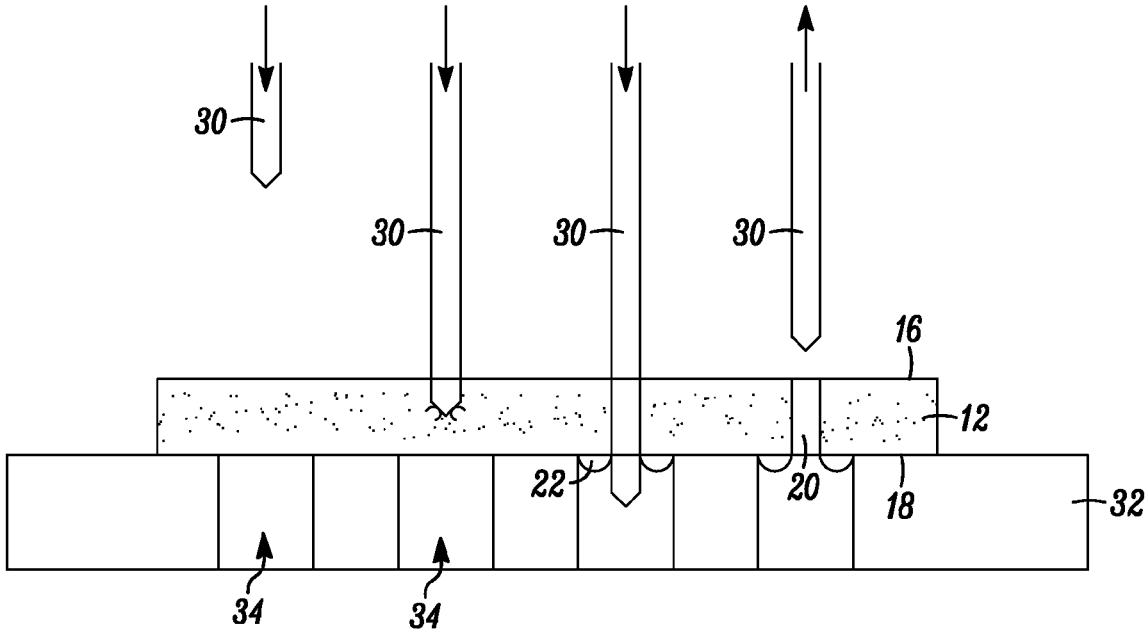
FIG. 4 is a somewhat schematic, cross-sectional view of the venting liner of FIG. 1 mounted within an apparatus for extruding the fluid-flow apertures, and illustrating a plurality of porolating pins or other extrusion members that are driven into and out of engagement with the outer layer of the liner to form the substantially vertical fluid-flow apertures and the extruded nubs on the outer surface of the liner adjacent to the fluid-flow apertures.

Turning to FIG. 4, an exemplary apparatus for porolating the outer layer 12 includes a plurality of porolating or extruding pins 30 that are drivingly mounted over a support surface 32 defining a plurality of die apertures 34 formed therein that are aligned or alignable with respective porolating pins 30. As can be seen, the outer layer 12 is supported on the support surface 32 with the outer side 18 thereof contacting the support surface, and the pins 30 are driven into engagement with the outer layer 12 to pierce or porolate the outer layer. As can be seen, as each pin 30 is driven into engagement with the outer layer 12, the tip of the pin extrudes the material of the outer layer inwardly toward the outer surface 18. In some embodiments the nubs are not annular, but rather each nub extends about only a portion or portions of the respective fluid-flow apertures. In the embodiments employing a multiple ply foam outer layer 12, each nub may be formed by extruded materials of all plies, or from the material of less than all plies. When the tip of each pin 30 is driven through the outer layer 12, the extruded material is deposited on the outer surface 18 at the periphery of the resulting fluid-flow aperture 20 and in the annular space formed between the pin and the surfaces of the respective die aperture 34. Accordingly, the nubs 22 are extruded by the pins 30 and deposited by the pins on the outer surface 18 of the liner adjacent to the outlet end of the resulting fluid-flow aperture 20.

In the illustrated embodiment, each fluid-flow aperture 20 is substantially circular in shape; however, the outer surface material can be resilient, and thus the material forming each aperture may close or substantially close on itself, while nevertheless allowing the flow of air and/or other gas therethrough. Also in the illustrated embodiments, the pins or other extrusion members forming the apertures each defines a diameter within the range of about 0.01 inch to about 0.1 inch, and preferably within the range of about 0.02 inch to about 0.08 inch; in one such embodiment, the pins or other extrusion members define a diameter of about 0.05 inch; and adjacent apertures (or pins forming the apertures) are laterally spaced relative to each other a distance within the range of about ¼ inch to about ¾ inch. As may be recognized by those of ordinary skill in the pertinent art based on the teachings herein, the nubs or relatively raised portions may take any of numerous different shapes or configurations that are currently known, or that later become known. In some embodiments of the present invention, the nubs extend about only a portion of the peripheries of the respective fluid-flow apertures. If desired, the nubs need not be formed by extruding the outer layer material, but rather may be formed by molding the outer layer in the desired configuration, or by otherwise depositing the nubs onto the outer layer of the liner. In addition, the nubs and/or outer layer may be subjected to any of numerous different post extruding or porolating processes that are currently known, or that later become known. In the illustrated embodiment, the porolating pins 30 define conically-pointed tips; however, the pins or other extrusion members may take any of numerous different shapes and/or configurations that are currently known, or that later become known.

Figure 5:
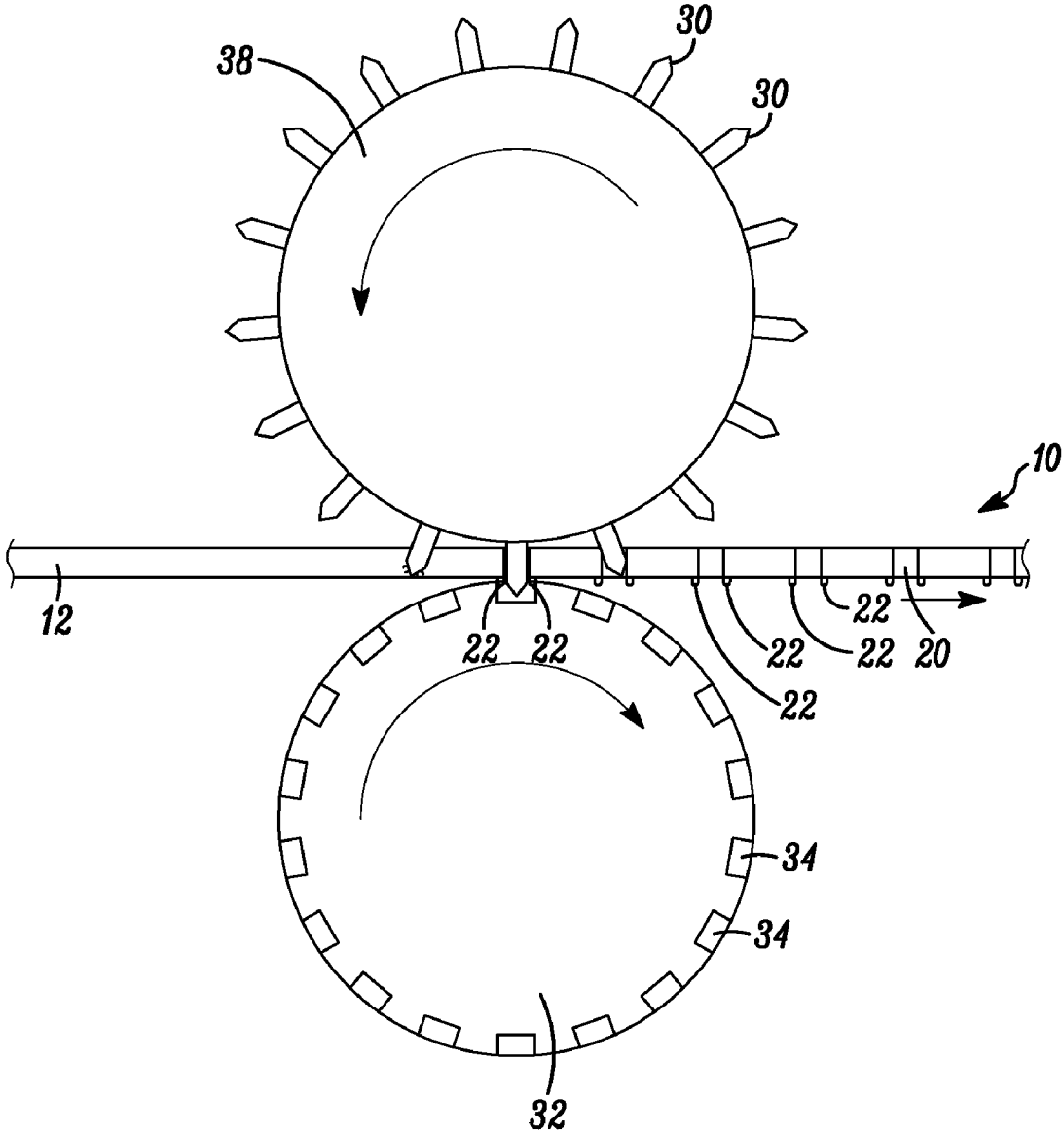
FIG. 5 is a side elevational, partial cross-sectional view of an exemplary apparatus for extruding the fluid-flow apertures in the outer layer of the venting liner, including a roller with radially projecting pins for engaging the outer layer and extruding the fluid-flow apertures, and an opposing support surface defining die apertures aligned with respective pins of the roller for receiving the pins and extruded material forming the nubs or other relatively raised portions on the outer surface of the liner.

As shown in FIG. 5, in one embodiment of the present invention, the apparatus for forming the venting liner 10 includes a rotatably driven roller 38 including a plurality of porolating pins or other extrusion members 30 laterally spaced relative to each other and projecting outwardly therefrom. The porolating pins 30 may define either of the patterns shown in FIG. 3A or 3B, or may define any of numerous other pin patterns to form any of numerous other fluid-flow aperture patterns that are currently known, or that later become known. The porolating roller 38 is rotatably mounted over a support surface 32 which in the illustrated embodiment is defined by a support roller. The support surface 32 defines therein the plurality of die apertures 34 for receiving therein the porolating pins 30 of the pin roller when piercing and extruding the material of the outer layer to form the fluid-flow apertures 20 and nubs 22. As can be seen, the outer layer 12 is driven through the space formed between the opposing rollers, and as each pin 30 pierces the outer layer 12, the pin tip is received within a respective die aperture 34 of the support roller 32 to extrude the material and in turn form the resulting nub and fluid-flow aperture. The extruded material is deposited in the annular space between the pin and the surface defining the respective die aperture. As may be recognized by those of ordinary skill in the pertinent art based on the teachings herein, the support surface and pin support may take any of numerous different configurations that are currently known, or that later become known. For example, the extruding members or porolating pins may be mounted on one or more plates that are driven toward and away from the support surface (or vice versa) to porolate the outer layer and extrude the nubs.

After the outer layer 12 is porolated, the inner surface 16 of the outer layer is laminated to the inner layer 14, such as by the application of heat and pressure as described above, to form a laminated sheet of the inner and outer layers. The liners 10 are then die cut or otherwise formed from the laminated sheet in a manner known to those of ordinary skill in the pertinent art.

As may be recognized by those of ordinary skill in the pertinent art based on the teachings herein, numerous changes and modifications may be made to the above-described and other embodiments of the present invention without departing from its scope as defined in the appended claims. For example, the inner and outer layers may be made of any of numerous different materials that are currently known or that later become known, the dimensions and/or configurations of the layers, of the pores and/or of the fluid-flow apertures, may take any of numerous different dimensions and/or configurations that are currently known or that later become known. The liners likewise may include any desired number of layers to impart any of numerous different physical properties, chemical properties, and/or characteristics for addressing any of numerous different applications or other requirements or otherwise as desired. In addition, the liners may be used to vent any of a variety of different devices, such as any of a variety of different containers, batteries, or other devices that require a liquid to be sealed within the device and a gas to be vented out of the device. The substantially vertical fluid-flow apertures in the outer layer likewise may be formed in any of numerous different ways that are currently known, or that later become known, including ways that do not form nubs at the outlet ends of the apertures. In some such embodiments, a substantially horizontal fluid flow path nevertheless may be formed between the outer layer of the liner and the closure in any of numerous different ways that are currently known, or that later become known, such as by forming the path in the closure and/or by forming another type of structure on the outer layer of the liner that may cooperate with the closure to form one or more substantially horizontal fluid flow paths and/or substantially vertical fluid flow paths for venting the gas from the liner through and/or around the closure and into the ambient atmosphere. Accordingly, this detailed description of the currently preferred embodiments of the present invention is to be taken in an illustrative as opposed to a limiting sense.

What is claimed is:

1. A venting liner connectable in fluid communication between a closure and an interior of a device for venting gas from the interior into an ambient atmosphere, the venting liner comprising:

an outer layer defining an inner surface and an outer surface, a plurality of fluid-flow apertures spaced relative to each other, extending between the inner and outer surfaces, and forming substantially vertical fluid-flow paths through the outer layer, an inner layer defining a plurality of pores in fluid communication with at least a plurality of the fluid-flow apertures of the outer layer that substantially prevent the flow of liquid through the inner layer and allow the flow of gas from the interior of the device through the pores, into at least a plurality of the fluid-flow apertures and, in turn, through at least one of a substantially horizontal fluid-flow path and a substantially vertical fluid flow path coupled in fluid communication between the outer surface and the ambient atmosphere; and a plurality of relatively raised portions extending outwardly relative to the outer surface contiguous to respective fluid-flow apertures, wherein at least a plurality of the relatively raised portions are engageable with the closure, define at least one substantially horizontal fluid-flow path between the outer surface and the closure, and are in fluid communication with at least one fluid-flow aperture for venting gas flowing substantially vertically through the at least one fluid-flow aperture and, in turn, substantially horizontally between the outer surface and the closure.

2. A venting liner as defined in claim 1, wherein the outer layer is a foam layer.

3. A venting liner as defined in claim 2, wherein the foam layer includes a plurality of layers.

4. A venting liner as defined in claim 3, wherein the foam layer includes an inner foam layer and opposing outer substantially solid layers.

5. A venting liner as defined in claim 1, wherein the outer surface of the outer layer is substantially planar.

6. A venting liner as defined in claim 1, wherein the plurality of relatively raised portions are formed by outer layer material extruded through at least one respective aperture to form the aperture.

7. A venting liner as defined in claim 1, wherein the inner layer is at least one of PTFE and ePTFE.

8. A venting liner as defined in claim 1, wherein the inner layer is laminated directly to the outer layer without any intervening layer.

9. A venting liner as defined in claim 1, wherein the outer layer defines a thickness within the range of about 0.01 inch to about 0.12 inch, and the inner layer defines a thickness within the range of about 0.002 inch to about 0.006 inch.

10. A venting liner as defined in claim 1, wherein the fluid-flow apertures are vertically oriented.

11. A venting liner as defined in claim 1, wherein each of at least a plurality of the relatively raised portions is contiguous with only a portion of a periphery of a respective fluid-flow aperture.

12. A venting liner as defined in claim 1, wherein the outer layer is compressible to facilitate forming a liquid-tight seal between the closure, venting liner, and device.

13. A venting liner as defined in claim 1, wherein the at least one substantially horizontal fluid-flow path between the outer surface and the closure is tortuous.

14. A venting liner as defined in claim 1, in combination with a device and a closure, wherein the venting liner is connected in fluid communication between the closure and an interior of the device for venting gas from the interior into the ambient atmosphere, and the outer layer and closure cooperate to define at least one of a substantially horizontal fluid-flow path and a substantially vertical fluid flow path coupled in fluid communication between the outer surface and the ambient atmosphere.

15. A venting liner as defined in claim 1, made in accordance with a method comprising the following steps:

extruding outer layer material in the direction from the inner surface toward the outer surface at a plurality of locations spaced relative to each other and, in turn, forming the relatively raised portions with the extruded material, and the fluid-flow apertures with voids in the outer layer resulting from the extruding.

16. A venting liner as defined in claim 15, wherein the extruding step comprises:

piercing the outer layer with at least one extrusion member;

extruding outer layer material with the at least one extrusion member in the direction from the inner surface toward the outer surface of the outer layer;

depositing extruded outer layer material in relatively raised portions extending outwardly relative to the outer surface of the outer layer; and removing the at least one extrusion member from the outer layer and, in turn, forming the fluid-flow paths at the penetration locations of the at least one extrusion member.

17. A venting liner as defined in claim 1, wherein the outer surface of the outer layer is defined by a substantially planar surface extending between the plurality of apertures, and the substantially horizontal fluid flow path is defined between the substantially planar surface and the closure.

18. A venting liner as defined in claim 17, wherein the relatively raised portions extend outwardly from the substantially planar outer surface.

19. A venting liner connectable in fluid communication between a closure and an interior of a device for venting gas from the interior into an ambient atmosphere, the venting liner comprising:

first means for forming an outer surface of the venting liner, wherein the first means includes a plurality of second means spaced relative to each other for forming a plurality of substantially vertical fluid-flow paths through the first means, third means for forming an inner surface of the venting liner and including a plurality of fourth means in fluid communication with at least a plurality of the second means for substantially preventing the flow of liquid through the third means and allowing the flow of gas from the interior of the device through the third means, into at least a plurality of the second means and, in turn, through at least one of a substantially horizontal fluid-flow path and a substantially vertical fluid flow path and into the ambient atmosphere; and a plurality of fifth means extending outwardly relative to the outer surface contiguous to respective second means for engaging the closure, defining at least one substantially horizontal fluid-flow path between the outer surface and the closure, and in fluid communication with at least one second means for venting gas flowing substantially vertically through the second means and, in turn, substantially horizontally between the outer surface and the closure.

20. A venting liner as defined in claim 19, wherein the first means is an outer layer, the second means is a plurality of fluid-flow apertures, the third means is an inner layer of the venting liner, the fourth means is a plurality of pores formed in the inner layer, and the fifth means is a plurality of relatively raised portions on the outer layer.

* * * * *